US005172681A

United States Patent [19]

Ruark et al.

[11] Patent Number: 5,172,681

[45] Date of Patent: Dec. 22, 1992

[54] RECIPROCATING POINT ROTARY DIAMOND TRUEING AND DRESSING TOOL AND METHOD OF USE

[75] Inventors: William W. Ruark, Westerville; Robert L. Henry, Hilliard, both of Ohio

[73] Assignee: General Electric Company, Worthington, Ohio

[21] Appl. No.: 635,082

[22] Filed: Dec. 28, 1990

[51] Int. Cl.[5] ..... B28D 5/04

[52] U.S. Cl. ..... 125/38; 51/206 P; 51/5 D

[58] Field of Search ..... 125/38, 39; 51/206 R, 51/206 P, 5 D

[56] References Cited

U.S. PATENT DOCUMENTS 1,646,501 10/1927 Slade ..... 125/39

3,398,989 8/1968 Christensen ..... 125/39

3,646,708 3/1972 Jones ..... 51/5 D 4,404,774 9/1983 Sadao ..... 51/5 D

*Primary Examiner*—M. Rachuba

[57] ABSTRACT

There is provided a tool for trueing and dressing a variety of grinding wheels to an open and aggressive surface condition, comprising a wheel having a thin layer of diamond particles in a plane oblique to the rotational axis of the tool. There is also provided a method for trueing and dressing a grinding wheel, by engaging the periphery of a rotating grinding wheel with a rotating trueing and dressing tool having a thin layer of diamond particles in a plane oblique to the rotational axis of said tool, with the diamond layer forming a reciprocating point having an effective cutting crossfeed rate relative to the speed of said rotating tool and the angle of said diamond layer.

15 Claims, 3 Drawing Sheets

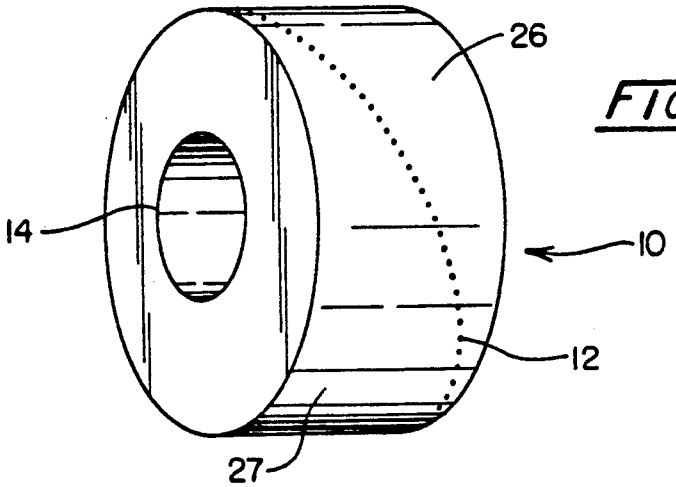
FIG. 1
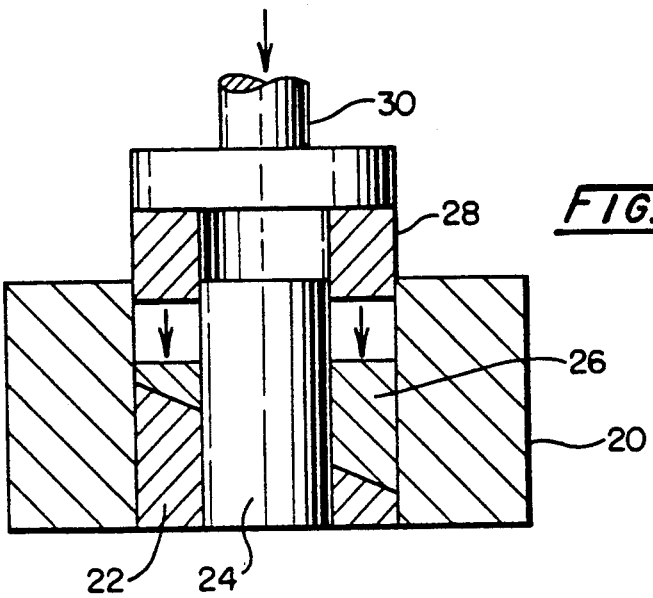
FIG. 2
FIG. 3
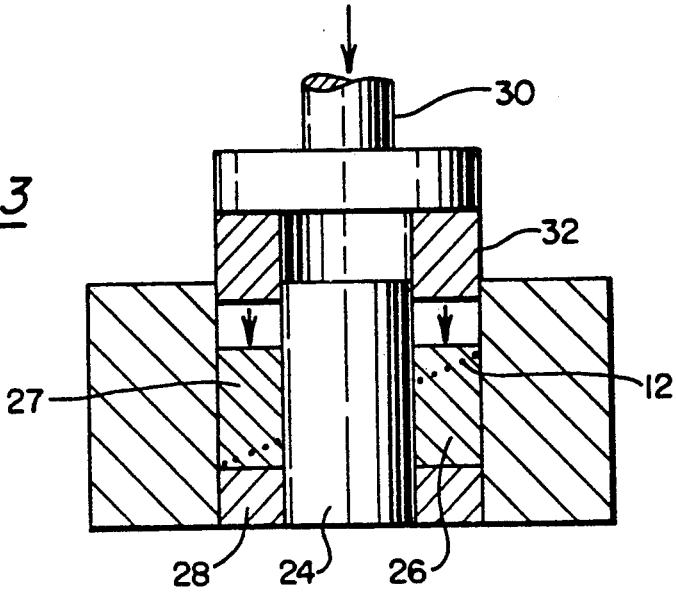

RECIPROCATING POINT ROTARY DIAMOND TRUEING AND DRESSING TOOL AND METHOD OF USE

BACKGROUND OF THE INVENTION

The present invention relates to a novel trueing and dressing tool for trueing and dressing grinding wheels. More particularly, the present invention relates to a method for trueing and dressing grinding wheels having vitrified-bonded cubic boron nitride (CBN) abrasive by using a reciprocating point trueing and dressing tool mounted between the head stock and tail stock of a cylindrical type grinding machine or on any suitable brake-controlled or powered rotary device for surface grinding machines.

A number of grinding wheels are known to those skilled in the art including, for example, conventional aluminum oxide and silicon carbide grinding wheels, resin-bonded and vitrified-bonded CBN grinding wheels, as well as, diamond grinding wheels. However, regardless of the type of abrasive employed in the grinding wheel, it is necessary to periodically true and dress the grinding wheel in order to maintain an open and aggressive grinding surface of a known profile. An open and aggressive surface condition is generally desirable since an open grinding wheel is less likely to burn a workpiece and requires less grinding power than a closed, or dull wheel.

A variety of methods for trueing and dressing grinding wheels are known in the art; however, each has various drawbacks and disadvantages, particularly in regard to trueing and dressing grinding wheels whose abrasive material is diamond or vitrified-bonded CBN. One prior art method is disclosed in U.S. Pat. No. 2,791,211 to Nagy and involves periodically indexing a diamond-tip dressing tool in relation to the grinding wheel so that in all indexing positions the diamond is in contact with the wheel in a direction of hard grain, forming an angle of between 30° and 45° to the crystal axis of the diamond. While such a single point diamond tool is effective for dressing conventional grinding wheels, such as aluminum oxide or silicon carbide, the diamond tip is subject to rapid wear and is generally ineffective for use in dressing grinding wheels employing diamond or vitrified-bonded CBN.

Another prior art method is disclosed in U.S. Pat. No. 4,866,887 to Imai, et al., and involves first trueing the grinding wheel with a trueing tool by making several passes across the grinding wheel at a relatively small infeed rate with a nib type dressing tool. In the final traverse feed, after the majority of the crown has been moved from the grinding wheel, the infeed rate of the trueing tool is set at a relatively larger value in order to form an aggressive cutting edge on the grinding wheel. A disadvantage of this method for trueing and dressing a grinding wheel appears from the number of cycles required in order to true the grinding wheel, as well as the expense involved in the central control unit used to control the infeed rates and positioning of the trueing and dressing tool. More importantly, such a tool is subject to rapid wear and loss of tool point geometry when used on diamond and vitrified-bonded CBN grinding wheels.

A number of alternatives to single point trueing and dressing tools are known in the art and include hand-set diamond and metal-bonded diamond rotary cup and straight wheel tools, as disclosed in U.S. Pat. No. 4,915,089 to Ruark, et al., which is assigned to the same assignee as the present invention and incorporated by reference into the present disclosure. While such rotary trueing and dressing tools have significantly longer life than single point tools, they are generally ineffective in generating the sharp, aggressive cutting surface on the grinding wheel produced by a single point dresser. Furthermore, they may require relatively expensive hydraulic or electric precision drive motors and spindle assemblies. Consequently, small machine shops are generally unable to avail themselves of rotary dressing technology. Another disadvantage of rotary cup wheel dressing tool technology is the necessity of periodically changing the position or angle of the dressing wheel in order to present new, sharper edges to the dressed wheel as the originally presented edges wear flat. Straight wheel dressing tools suffer from the further disadvantage of having the abrasive applied to the circumferential surface of the wheel in a band several millimeters in width. As a result, the operator has very little control over the dressed surface of the vitrified-bonded CBN or diamond grinding wheels because a wide band of abrasive, unlike a sharp point, generally leaves the wheel in a closed or dull condition. Wheels in such a dull condition are not desirable because they can generate excessive heat during the grinding process, which may cause the wheel to burn the workpiece. The powered rotary dressing tool as disclosed in Ruark, et al., while overcoming the disadvantage of the wide diamond width by its substitution of a single layer of diamond mounted in an axis perpendicular to the rotational axis of the dressing wheel, still requires a high degree of control over the rate of traverse to generate a sharp and open grinding wheel surface. In some cases, the rate of traverse required to generate an open wheel may exceed the physical capability of the grinding machine. Such additional traversing requirements may prohibit implementation or add an expense element to the trueing and grinding of diamond or vitrified-bonded CBN grinding wheels that would put the availability of such technology beyond the reach of small machine shops.

While such prior art methods may be considered acceptable, despite their respective shortcomings, manufacturers are always concerned with improving the trueing and dressing process, such as by reducing the time required to true and dress a grinding wheel to a sharp and open condition, reducing the costs of the trueing and dressing tool itself, and improving the quality of the profile of the trued grinding wheel surface.

SUMMARY OF THE INVENTION

It is an object of the present invention to provide a diamond, reciprocating point trueing and dressing tool.

It is another object of the present invention to provide a method for making a diamond, reciprocating point trueing and dressing tool.

It is yet another object of the present invention to provide a method for trueing and dressing a grinding wheel with a diamond, reciprocating point trueing and dressing tool that can be mounted between the head stock and tail stock of a cylindrical grinding machine in place of the workpiece.

In accordance with one aspect of the present invention, there is provided a tool for trueing and dressing a grinding wheel, comprising a wheel having a thin layer of mesh size diamond in a plane oblique to the rotational axis of said trueing and dressing tool. Preferably, the thin layer of diamond is only a single layer of diamond in width and is disposed between the sides of the trueing and dressing tool.

In accordance with another aspect of the present invention, there is provided a method for trueing and dressing a grinding wheel, comprising engaging the periphery of the rotating grinding wheel with a rotating trueing and dressing tool disposed intermediate the head stock and tail stock of a powered grinding machine. In a less preferred embodiment, a powered rotary or braking device may be employed to engage the trueing and dressing tool with a rotating grinding wheel. In this embodiment, the trueing and dressing tool would be more suited for surface type or universal grinding machines.

The unique configuration of the diamond particles in the present invention yields a single point of contact with a grinding wheel, similar to that of a single point NIB truer and dresser. However, since unworn diamond particles are made available as the wheel wears through the depleted diamond layer, the life of the tool of the present invention is dramatically increased over that of a conventional single point diamond trueing and dressing tool.

In additional to increased tool life, the unique reciprocating path of the rotating diamond layer disclosed in the present invention produces an aggressive trueing and dressing effect similar to that of a high crossfeed rate, even while the invention is laterally stationary. This should enable the impartment of high crossfeed rate effects onto the surfaces of grinding wheels beyond the mechanical limitations of the grinding machines and without damage to the grinding wheels themselves.

BRIEF DESCRIPTION OF THE DRAWINGS

FIG. 1 is a front elevational view of a trueing and dressing tool constructed in accordance with the present invention;

FIG. 2 is a front sectional view of the method of manufacture of a trueing and dressing tool in accordance with the present invention;

FIG. 3 is a front sectional view of the method of manufacture of a trueing and dressing tool in accordance with the present invention;

DETAILED DESCRIPTION OF THE INVENTION

Figure 5:
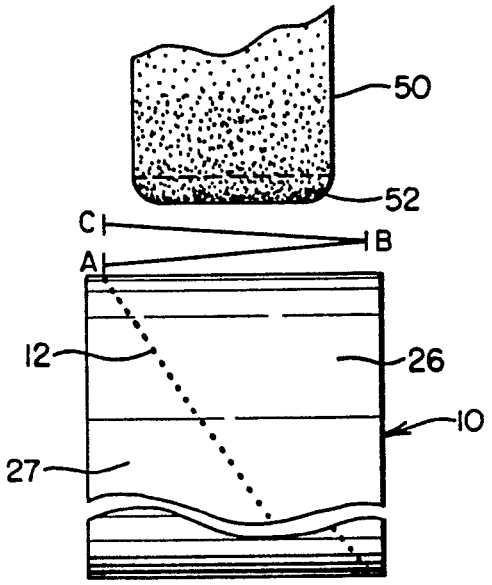
FIG. 5 is a partial sectional view of a trueing and dressing tool for practicing the trueing and dressing method according to the present invention.

There is provided by the present invention a tool for trueing and dressing a grinding wheel, comprising a wheel having a thin layer of diamond particles in a plane oblique to the rotational axis of said wheel. Although the trueing and dressing tool of the present invention is especially suited for trueing and dressing large diameter vitrified-bonded CBN grinding wheels, it may also be used effectively and efficiently on conventional grinding wheels such as, for example, aluminum oxide and silicon carbide, as well as resin-bonded CBN grinding wheels and diamond grinding wheels.

Referring now to the drawings, FIG. 1 generally shows the trueing and dressing tool 10 in accordance with the present invention. Trueing and dressing tool 10 preferably comprises a thin layer of diamond 12 disposed intermediate a first metal section 26 and a second metal section 27. Inasmuch as diamond layer 12 functions to true and dress the grinding wheel, the more narrow the diamond layer 12, the more closely the trueing and dressing tool of the present invention will operate as a single point trueing device. Although it is most preferred that diamond layer 12 only be a single diamond in width, in some instances, it may be desirable or practical to prepare tools wherein diamond layer 12 is several diamonds in width, for example, up to about 0.8 mm in width, so as to provide a reciprocating fine point trueing and dressing tool.

Diamond particles of any size may be employed in diamond layer 12, depending upon the trueing and dressing requirements. Preferably, larger size diamond particles, e.g., 20/25 to 30/40 U.S. mesh size, are utilized for trueing and dressing vitrified-bonded CBN grinding wheels, as they provide a longer useful life. However, the present invention may be employed using diamond particles of 60/80 U.S. mesh size and finer depending upon the application. The artisan will be able to select suitable diamond particle sizes for use in trueing and dressing other types of grinding wheels without undue experimentation.

Wheel sections 26 and 27 may consist of any suitable bonding material, with harder bonding materials, such as those containing iron or cobalt, being the most preferred. In the preferred embodiment, ferrous bonding materials are used in sections 26 and 27 in applications involving resin-bonded and vitrified-bonded CBN grinding wheels 50 (See FIG. 5). In its preferred embodiment, trueing and dressing tool 10 employs carbide bonding material for wheel sections 26 and 27 for trueing and dressing diamond grinding wheels 50. The most important criterion in the selection of a suitable material for wheel sections 26 and 27, is that the bonding material must be sufficiently hard to retain the diamond layer 12 in the trueing and dressing tool of the present invention and yet be one that will not deform or vibrate during use.

FIGS. 2 and 3 illustrate a preferred method for making the reciprocating point rotary diamond trueing and dressing tool 10 of the present invention. Initially, first section 26 is cold-pressed in mold 20 by means well known in the art. Under a normal production run, first section 26 could as well be hot-pressed in suitable quantities prior to final pressing. Wheel section 26 is formed by partially filling the mold cavity, formed by tapered plug 22 and core plug 24, with bonding material determined suitable for the trueing and dressing application. Once wheel section 26 has been cold-pressed, that section then is inverted in the second mold cavity configuration formed by first press ring 28 and core plug 24, essentially as depicted in FIG. 3. Once wheel section 26 is in place within mold 20, diamond layer 12 then is added upon the upper surface of wheel section 26. A number of suitable methods of applying diamond layer 12 are available and include sprinkling diamond particles over adhesive which has been applied to the upper surface of wheel section 26; applying diamond upon the upper surface of wheel section 26 by a chemical vapor deposition process, as disclosed in U.S. Pat. Nos.

4,707,384, 4,749,587, 4,767,608, 4,830,702, 4,434,188 and 4,740,263, incorporated by reference into the present disclosure; or by applying a thin disk of suitable bonding material upon which a diamond layer has been affixed either by adhesive, chemical vapor deposition, or other bonding means. Regardless of the method employed for adding diamond layer 12, once in place, an additional amount of metal bonding powder is placed into mold 20 sufficient to form second wheel section 27. After the second press ring 32 is added to the mold configuration, the wheel sections 26 and 27 are hot-pressed to form trueing and dressing tool 10. It is obvious that a straight or threaded core of steel or other suitable material may be used as a hub for finished wheel 10 and may be installed during or following fabrication.

While the preferred embodiment is shown to contain a mono-oblique layer of diamond particles 12 relative to the rotational axis of trueing and dressing tool 10, the present invention also encompasses wheels comprised of poly-oblique layers, such as in a sawtooth or sinusoidal pattern. While a poly-oblique configuration of wheel 10 may increase the manufacturing complexity, it offers the advantage of increasing the effective crossfeed rates of the diamond contact in direct proportion to the number of reciprocating cycles of diamond layer 12 per revolution of wheel 10 (See cycle A–C of FIG. 5).

Figure 4:
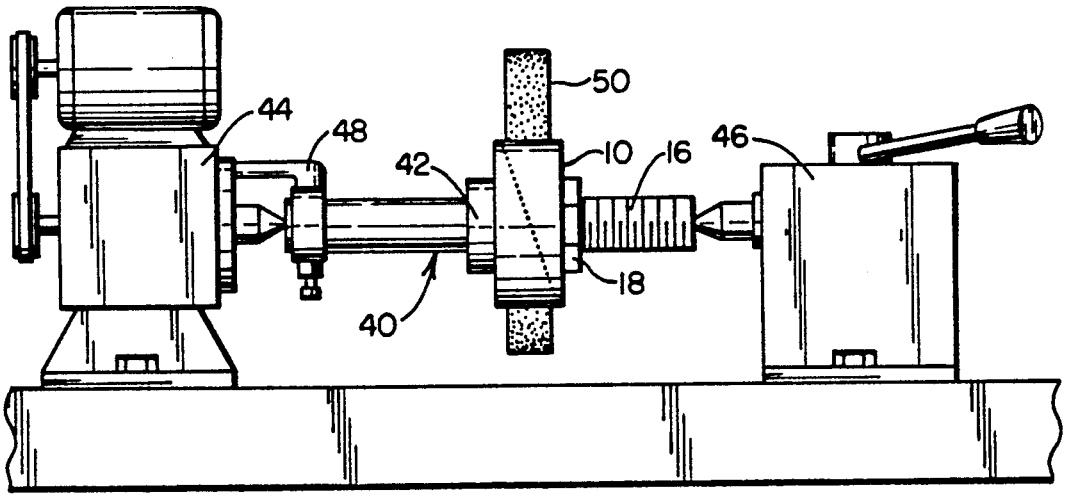
FIG. 4 is a front elevational view of the trueing and dressing tool mounted on a cylindrical grinding machine.
Figure 6:
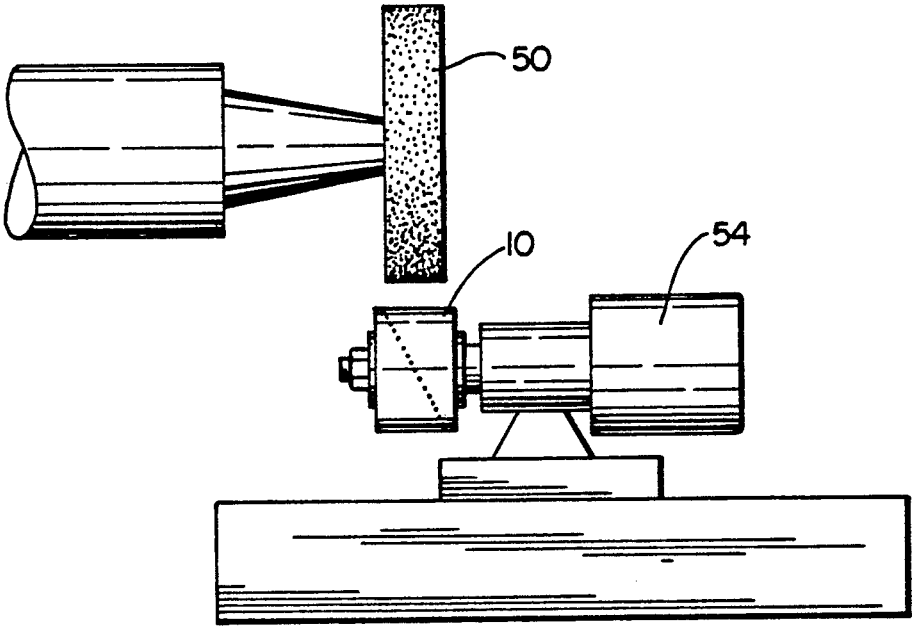
FIG. 6 is a front elevational view of a trueing and dressing tool installed on a brake-type rotary trueing device and mounted beneath the grinding wheel of a surface grinding machine.

FIG. 4 illustrates one means for securing the trueing and dressing tool 10 of the present invention to a threaded spindle 40 and flange 42 arrangement which can be mounted between head stock 44 and tail stock 46 of a cylindrical grinding machine. To do so, trueing and dressing tool 10 is mounted through its central hole 14 onto spindle 40 into facing abutment with flange 42. Tool 10 is then held in non-rotational abutment against flange 42 by means of a threaded retaining nut 18. The assembly then, formed by trueing and dressing tool 10, spindle 40, flange 42, and retaining nut 18, is inserted and secured into driving dog 48 in the same manner as would a workpiece. It is obvious that trueing and dressing tool may be fabricated with a threaded hub with the same thread pitch as spindle threads 16 in order to non-rotatably affix tool 10 to spindle 40. Alternatively, the assembly formed by trueing and dressing tool 10, flange 42, spindle 40, and retaining nut 18, may be affixed to a head chuck, not shown. In an alternative embodiment, such as for surface type grinding machines, essentially as shown in FIG. 6, trueing and dressing tool 10 may be non-rotatably affixed to a shaft of a conventional brake controlled trueing and dressing device 54 and secured to base 56. Such a braking device is disclosed by U.S. Pat. No. 4,811,721 to Altfather. However, any suitable powered rotary trueing and dressing device would work as well.

Trueing and dressing of grinding wheel 50 is effected by engaging the periphery of said wheel with rotating trueing and dressing tool 10. Rotational power for the trueing and dressing tool 10 is supplied by the work head of the grinding machine and is transmitted to the trueing and dressing tool 10 by way of driving dog 48 or alternately, the workpiece chuck assembly, not shown. Although greater convenience is obtained when rotational power is provided to trueing and dressing tool 10 in this manner, the wheel is equally effective when driven by a precision spindle and drive motor, also not shown. Alternately, as previously disclosed, rotational power for trueing and dressing tool 10 may be supplied by physical contact with the grinding wheel itself, essentially as shown in FIG. 6.

Referring to FIG. 5, trueing and dressing is accomplished by bringing rotating grinding wheel 50 into abrading abutment with rotating trueing and dressing tool 10. There it can be seen that rotating trueing and dressing tool 10 will cause rotating diamond layer 12 to cycle in a reciprocating pattern at the contacting surface between wheel 10 and grinding wheel 50. For any given wheel, the effective trueing and dressing width of the wheel will be determined by the outer limits of diamond layer 12, as depicted by length A–B in FIG. 5. To compensate for grinding wheels which may be wider than reciprocating path A–B, the crossfeed of trueing and dressing tool 10 may be extended using the lateral feed controls (not shown) of the grinding machine. Slow lateral movement using the feed controls of the grinding machine should yield the same desirable aggressive and open surface condition of dressed grinding wheel 50 as the reciprocating action of rotating trueing and dressing tool 10 alone. The rate of reciprocation of the single point or fine point diamond, i.e., the time it takes diamond layer 12 to traverse through one-half cycle, is the effective crossfeed rate of wheel 10 and is a function of the angle of the diamond layer 12 relative to the rotational axis of trueing and dressing tool 10 as well as its rotational speed. Using the powered table and feed controls of the grinding machine, trueing and dressing tool 10 and the grinding wheel 50 are brought into abrading contact until the desired amount of grinding wheel crown 52, generally depicted in FIG. 5, is removed. The aggressiveness of the surface condition generated on grinding wheel 50 can be controlled by increasing or decreasing the trueing and dressing rate, i.e., increasing or decreasing the infeed rate or increasing or decreasing the r.p.m. of trueing and dressing tool 10, thus controlling its effective crossfeed rate.

We claim:

1. A tool for trueing and dressing a grinding wheel comprising a trueing and dressing wheel having a periphery, a rotational axis and a thin, generally planar layer of diamond particles integrally-incorporated into said trueing and dressing wheel at an angle of bisection oblique to said rotational axis and having an exposed edge circumscribing said periphery, said exposed edge of the diamond layer forming on said periphery a reciprocating point having a lateral displacement perpendicular to said rotational axis when said dressing and trueing wheel is rotated about said rotational axis and replenished with unworn diamond particles from said diamond layer as said trueing and dressing wheel wears through.

2. The tool of claim 1, wherein the layer of diamond particles is a single diamond in width.

3. The tool of claim 1, wherein the layer of diamond particles range up to about 0.8 mm in width.

4. The tool of claim 1, wherein the size of the diamond particles in said layer is from about 0.17 millimeters to about 0.8 millimeters.

5. The tool of claim 1, wherein said layer of diamonds is attached to said tool by plating, metal bonding, or chemical vapor deposition.

6. The tool of claim 1, wherein the layer of diamond particles is disposed intermediate the sides of said tool.

7. The tool of claim 1, wherein said layer of diamond is in a plane oblique to the rotational axis of said wheel.

8. A method for trueing and dressing a grinding wheel having a width, comprising:

providing a trueing and dressing wheel having a periphery, a rotational axis and a thin, generally planar layer of diamond particles integrally-incorporated into said trueing and dressing wheel at an angle of bisection oblique to said rotational axis and having an exposed edge circumscribing said periphery, said exposed edge of the diamond layer replenished with unworn diamond particles from said diamond layer as said trueing and dressing wheel wears through;

rotating said trueing and dressing wheel about said rotational axis, said exposed edge of the diamond layer forming on said periphery a reciprocating point having a lateral displacement perpendicular to said rotational axis and having an effective cutting crossfeed rate relative to the speed of the rotating trueing and dressing wheel and the angle of said planar diamond layer;

rotating said grinding wheel; and engaging the rotating grinding wheel with said reciprocating point on said periphery of the rotating trueing and dressing wheel to effect trueing and dressing of said rotating grinding wheel.

9. The method of claim 8, wherein said displacement is greater than said width of a grinding wheel being trued and dressed.

10. The method of claim 8, wherein said trueing and dressing tool is disposed intermediate a head stock and a tail stock of a cylindrical grinding machine.

11. The method of claim 10, wherein rotational power is transmitted to said trueing and dressing tool via a driving dog.

12. The method of claim 10, wherein rotational power is transmitted to said trueing and dressing tool via a head chuck.

13. The method of claim 10, wherein rotational power is transmitted to said trueing and dressing tool via said grinding wheel.

14. The method of claim 13, wherein a braking means is employed to retard the rotation of said trueing and dressing tool.

15. The method of claim 8, wherein rotational power is transmitted via a motor coupled to said trueing and dressing tool.

* * * * *